US008540021B2

(12) United States Patent
McCarter et al.

(10) Patent No.: US 8,540,021 B2
(45) Date of Patent: Sep. 24, 2013

(54) RELEASE ASSEMBLY FOR A DOWNHOLE TOOL STRING AND METHOD FOR USE THEREOF

(71) Applicant: Halliburton Energy Services, Inc., Houston, TX (US)

(72) Inventors: Micky Roy McCarter, Spring, TX (US); Joshua Blake Howk, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/645,699

(22) Filed: Oct. 5, 2012

(65) Prior Publication Data

US 2013/0168083 A1 Jul. 4, 2013

(30) Foreign Application Priority Data

Nov. 29, 2011 (WO) ..... PCT/US2011/062405

(51) Int. Cl.

| | |
|---|---|
| ***E21B 4/04*** | (2006.01) |
| ***E21B 47/00*** | (2012.01) |
| ***E21B 17/00*** | (2006.01) |
| ***E21B 23/00*** | (2006.01) |

(52) U.S. Cl.
USPC ..... 166/250.01; 166/242.6; 166/377; 166/66.4

(58) Field of Classification Search
USPC ..... 166/250, 242.6, 377, 66, 66.41, 250.01, 166/66.4
See application file for complete search history.

(56) References Cited

U.S. PATENT DOCUMENTS

| | | | | |
|---|---|---|---|---|
| 4,883,120 | A | 11/1989 | Schateen et al. | |
| 5,050,682 | A | 9/1991 | Huber et al. | |
| 5,398,760 | A | 3/1995 | George et al. | |
| 6,009,948 | A * | 1/2000 | Flanders et al. | 166/301 |
| 6,626,244 | B2 * | 9/2003 | Powers | 166/373 |
| 6,763,883 | B2 * | 7/2004 | Green et al. | 166/250.17 |
| 6,820,693 | B2 * | 11/2004 | Hales et al. | 166/297 |
| 7,007,756 | B2 * | 3/2006 | Lerche et al. | 166/297 |
| 7,387,162 | B2 * | 6/2008 | Mooney et al. | 166/297 |
| 2002/0112860 | A1 * | 8/2002 | McDaniel | 166/381 |
| 2004/0134667 | A1 * | 7/2004 | Brewer et al. | 166/380 |
| 2005/0022987 | A1 * | 2/2005 | Green et al. | 166/250.17 |
| 2007/0125530 | A1 * | 6/2007 | Lerche et al. | 166/55.1 |

(Continued)

OTHER PUBLICATIONS

ISRWO, PCT/US2011/062405, KIPO (Sep. 24, 2012).

(Continued)

*Primary Examiner* — Daniel P Stephenson
*Assistant Examiner* — Michael Wills, III
(74) *Attorney, Agent, or Firm* — Lawrence R. Youst

(57) ABSTRACT

A release assembly (200) for releasing a portion of a tool string in a wellbore. The release assembly (200) includes an outer housing (202) having a fishing receptacle (206) disposed therein. The fishing receptacle (206) includes a fishing neck (208). A support assembly (214) is disposed within the housing (202). The support assembly (214) has a first position wherein the support assembly (214) engages the fishing neck (208) to prevent separation of the fishing receptacle (206) from the housing (202) and a second position wherein the support assembly (214) is disengaged from the fishing neck (208) no longer preventing separation of the fishing receptacle (206) from the housing (202). An actuator (224), disposed within the housing (202), maintains the support assembly (214) in the first position until actuation thereof allows the support assembly (214) to shift to the second position.

20 Claims, 4 Drawing Sheets

(56) References Cited

U.S. PATENT DOCUMENTS

| | | | | |
|---|---|---|---|---|
| 2007/0165487 | A1* | 7/2007 | Nutt et al. | 367/25 |
| 2009/0223670 | A1* | 9/2009 | Snider | 166/308.1 |
| 2009/0272529 | A1* | 11/2009 | Crawford | 166/250.15 |
| 2011/0067854 | A1 | 3/2011 | Love et al. | |
| 2011/0090091 | A1 | 4/2011 | Lerche et al. | |

OTHER PUBLICATIONS

Office Action, U.S. Appl. No. 13/645,793, USPTO (Apr. 24, 2013).

* cited by examiner

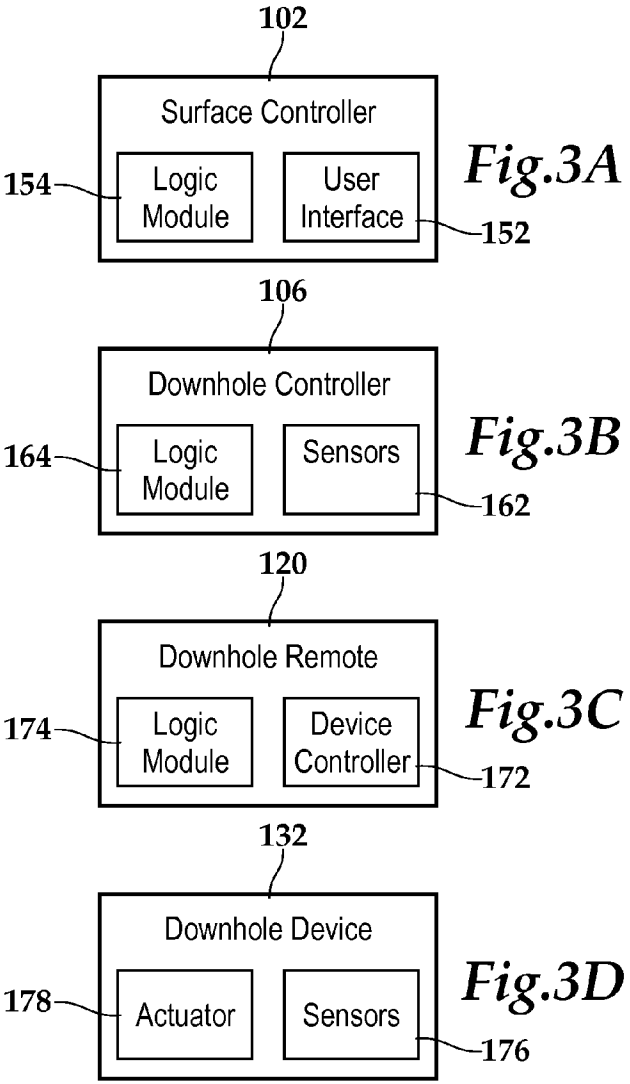
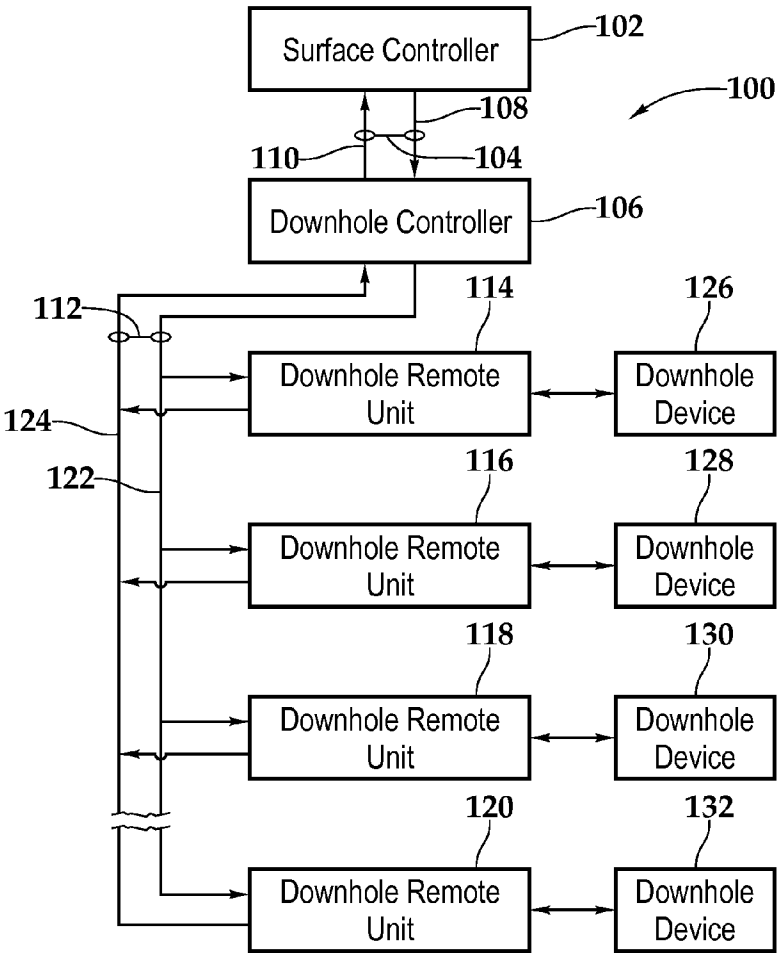
Fig.2

RELEASE ASSEMBLY FOR A DOWNHOLE TOOL STRING AND METHOD FOR USE THEREOF

CROSS-REFERENCE TO RELATED APPLICATIONS

This application claims the benefit under 35 U.S.C. §119 of the filing date of International Application No. PCT/US2011/62405, filed Nov. 29, 2011. The entire disclosure of this prior application is incorporated herein by this reference.

TECHNICAL FIELD OF THE INVENTION

This invention relates, in general, to equipment and techniques utilized in conjunction with operations performed in relation to subterranean wells and, in particular, to a release assembly for a downhole tool string and method for use thereof.

BACKGROUND OF THE INVENTION

Without limiting the scope of the present invention, its background will be described in relation to reservoir stimulation operations performed from a wellbore that traverses a hydrocarbon bearing subterranean formation, as an example.

It is well known in the well drilling and completion art that hydraulic fracturing of a hydrocarbon bearing subterranean formation is sometimes desirable to increase the permeability of the formation in the production interval or intervals adjacent to the wellbore. According to conventional practice, a fracture fluid is pumped through the wellbore into the formation with sufficient volume and pressure to open the desired fractures in the formation. In addition, during certain portions of the fracturing operation, the fracture fluid may carry suitable propping agents, such as sand, gravel or engineered proppants, which are deposited into the fractures and serve the purpose of holding the fractures open following the fracturing operation and providing highly conductive paths for reservoir fluids to the wellbore. Importantly, the success of the fracturing operation is dependent upon the ability to inject large volumes of hydraulic fracture fluid into desired locations within the formation at a high pressure and high flow rate.

It has been found, however, that it is difficult to achieve the desired stimulation in certain completions using conventional fracturing techniques. For example, in horizontal wellbores that may extend several thousand feet through a formation, it may be desirable to perform the fracturing operation in horizontal stages, wherein each stage may be several hundred feet in wellbore length. In such operations, each stage of the wellbore from the toe to the heel may be sequentially perforated, stimulated then isolated. In certain multistage horizontal completions, the plugging and perforating operations may be performed together using wireline techniques.

Due, for example, to residual proppant in uphole sections of the wellbore, it has been found that a wireline conveyed plug and perforate tool string may become stuck in the wellbore during such operations. In this event, while the wireline may be released at the cablehead and retrieved to the surface, this is not desirable as the plug and perforate tool string is left behind in the wellbore. Accordingly, a need has arisen for an improved tool string that is operable to plug and perforate a downhole interval during a multistage horizontal perforating and fracturing operation. A need has also arisen for such an improved tool string that is operable for at least partial retrieval in the event the tool string becomes stuck in the wellbore.

SUMMARY OF THE INVENTION

The present invention disclosed herein is directed to an improved tool string that is operable to plug and perforate a downhole interval during a multistage horizontal perforating and fracturing operation. In addition, the improved tool string is operable for at least partial retrieval in the event the tool string becomes stuck in the wellbore during such operations.

In one aspect, the present invention is directed to a method for releasing a portion of a tool string downhole of a release assembly positioned in a wellbore. The method includes providing a surface controller; running the tool string into the wellbore, the tool string including a downhole controller, a plurality of downhole remote units, a release assembly operably associated with a first one of the downhole remote units and a downhole tool positioned downhole of the release assembly; sticking the tool string in the wellbore; sending an actuation command including an address of the first downhole remote unit from the surface controller to the downhole controller; relaying the actuation command from the downhole controller to the first downhole remote unit; sending an actuation signal from the first downhole remote unit to the release assembly; and actuating the release assembly to release the portion of the tool string downhole thereof including the downhole tool.

The method may also include operating the downhole tool such as detonating a perforating gun or setting an isolation plug; sending an actuation command including a unique digital address of the first downhole remote unit; sending a voltage signal as the actuation signal or operating a solenoid to shift a sleeve out of engagement with jaws of a support assembly to release a fishing neck of a fishing receptacle.

In another aspect, the present invention is directed to a method for releasing a portion of a tool string downhole of a release assembly positioned in a wellbore. The method includes providing a surface controller; running the tool string including a downhole controller, a plurality of downhole remote units and a plurality of release assemblies each operably associated with one of the downhole remote unit into the wellbore; sticking the tool string in the wellbore; placing the tool string in tension; obtaining tension information at the surface controller from the release assemblies; identifying the first release assembly uphole of a location wherein the tool string is stuck based upon the tension information; sending an actuation command to the downhole remote unit operably associated with the first release assembly via the downhole controller; sending an actuation signal to the first release assembly from the downhole remote unit operably associated therewith; and actuating the first release assembly to release the portion of the tool string downhole thereof. The method may also include comparing tension information from each of the release assemblies to determine the location wherein the tool string is stuck.

In a further aspect, the present invention is directed to a system for releasing a portion of a tool string positioned in a wellbore. The system includes a surface controller. The system also includes a downhole controller positioned within the tool string and operable to communicate with the surface controller. A plurality of downhole remote units, positioned within the tool string, are operable to communicate with the downhole controller. A release assembly, also positioned within the tool string, is operably associated with a first one of the downhole remote units. A downhole tool is positioned downhole of the release assembly within the tool string. In operation, an actuation command including an address of the first downhole remote unit is sent from the surface controller to the downhole controller. The actuation command is relayed from the downhole controller to the first downhole remote unit. An actuation signal is sent from the first downhole remote unit to the release assembly. The release assembly is actuated to release the portion of the tool string downhole thereof including the downhole tool.

In one embodiment, the downhole tool is a perforating gun. In another embodiment, the downhole tool is an isolation plug. In certain embodiments, the address of the first downhole remote unit is a unique digital address. In some embodiments, the actuation may be a voltage signal. In one embodiment, the release assembly further includes a solenoid operable to shift a sleeve out of engagement with jaws of a support assembly to release a fishing neck of a fishing receptacle.

In an additional aspect, the present invention is directed to a release assembly for releasing a portion of a tool string in a wellbore. The release assembly includes an outer housing and a fishing receptacle disposed within the housing. The fishing receptacle has a fishing neck. A support assembly is disposed within the housing. The support assembly has a first position wherein the support assembly engages the fishing neck to prevent separation of the fishing receptacle from the housing and a second position wherein the support assembly is disengaged from the fishing neck no longer preventing separation of the fishing receptacle from the housing. An actuator is disposed within the housing. The actuator maintains the support assembly in the first position until actuation thereof allows the support assembly to shift to the second position.

In one embodiment, the support assembly may include a plurality of rotatable jaws that engage the fishing neck when the support assembly is in the first position. In this embodiment, the actuator may include a solenoid and an actuator sleeve operably associated with the solenoid. The actuator sleeve engages the rotatable jaws to maintain engagement of the rotatable jaws with the fishing neck until actuation of the solenoid shifts the actuator sleeve enabling rotation of the rotatable jaws out of engagement with the a fishing neck. In another embodiment, the release assembly may include one or more sensors, such as strain gauges, that are operable to identify a tension level in the release assembly.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which:

FIG. 2 is a communication diagram of a control system for a tool string with a plurality of release assemblies according to an embodiment of the present invention;

FIG. 3A is a functional block diagram of a surface controller of a control system for a tool string with a plurality of release assemblies according to an embodiment of the present invention;

FIG. 3B is a functional block diagram of a downhole controller of a control system for a tool string with a plurality of release assemblies according to an embodiment of the present invention;

FIG. 3C is a functional block diagram of a downhole remote unit of a control system for a tool string with a plurality of release assemblies according to an embodiment of the present invention;

FIG. 3D is a functional block diagram of a downhole tool operable to communicate with a control system for a tool string with a plurality of release assemblies according to an embodiment of the present invention;

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
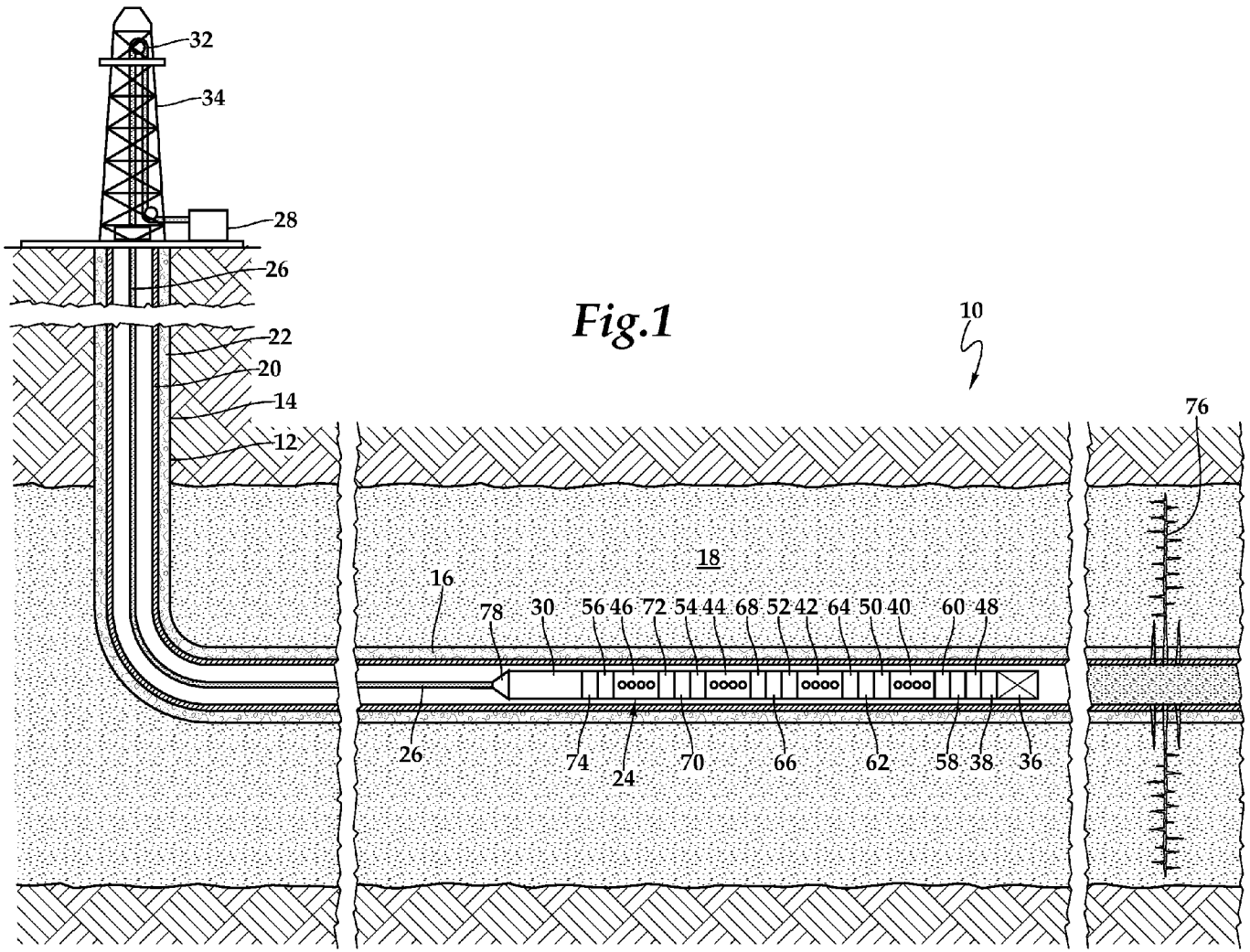
FIG. 1 is a schematic illustration of a well system having disposed therein a tool string with a plurality of release assemblies according to an embodiment of the present invention.

Referring initially to FIG. 1, therein is depicted a well system during a multistage horizontal perforating and fracturing operation that is schematically illustrated and generally designated 10. In the illustrated embodiment, a wellbore 12 extends through the various earth strata. Wellbore 12 has a substantially vertical section 14 and a substantially horizontal section 16 that extends through a hydrocarbon bearing subterranean formation 18. A casing string 20 is secured within wellbore 12 by cement 22.

In the illustrated embodiment, a tool string 24 is positioned within wellbore 12 on a lower end of a conveyance 26 such as a wireline or electric line. Conveyance 26 preferably includes one or more cables that are operable to transport and position tool string 24 within wellbore 12 and provide communication capability between a surface controller 28 and a downhole controller 30 that is part of tool string 24. In addition, conveyance 26 may also be operable to provide power from the surface to downhole controller 30 as well as the other components within tool string 24. In the illustrated embodiment, conveyance 26 is supported by a hoisting assembly 32 positioned within derrick 34. As illustrated, tool string 24 is deployed within wellbore 12 using a fluid delivery operation that propels tool string 24 in substantially horizontal section 16. Even though FIG. 1 describes and depicts a wireline type conveyance, it is to be understood by those skilled in the art that tool string 24 could alternatively be tubing conveyed.

At its lower end, tool string 24 includes an isolation plug 36 and a setting tool 38. Tool string 24 also includes a plurality of perforating guns 40, 42, 44, 46. Tool string 24 further includes a plurality of release assemblies 48, 50, 52, 54, 56, the operation of which will be described in greater detail below. In addition to downhole controller 30, as part of the control system, tool string 24 includes a plurality of downhole remote units 58, 60, 62, 64, 66, 68, 70, 72, 74. In the illustrated embodiment, downhole remote unit 58 is operably associated with release assembly 48, downhole remote unit 60 is operably associated with perforating gun 40, downhole remote unit 62 is operably associated with release assembly 50, downhole remote unit 64 is operably associated with perforating gun 42, downhole remote unit 66 is operably associated with release assembly 52, downhole remote unit 68 is operably associated with perforating gun 44, downhole remote unit 70 is operably associated with release assembly 54, downhole remote unit 72 is operably associated with perforating gun 46 and downhole remote unit 74 is operably associated with release assembly 56.

While the illustrated embodiment depicts a particular number of perforating guns, release assemblies and downhole remote units, those skilled in the art will recognize that a tool string such as tool string 24 may encompass any number of perforating guns, release assemblies and downhole remote units, as well as other tools depending on the number of independent perforating events desired and depending upon the number of locations within the tool string that separation may be desired. In addition, even though each perforating gun has been depicted and described as being associate with a downhole remote unit and a release assembly, those skilled in the art will recognize that more than one perforating gun, such as a tandem or a gun string may be associated with a single downhole remote unit and/or a single downhole remote unit, the number of perforating guns being dependent upon the length of the formation being perforated.

Also depicted in FIG. 1 is a fracture 76, which represents the uppermost fracture in the prior stage of the multistage horizontal perforating and fracturing operation. For example, substantially horizontal section 16 of wellbore 12 may extend for several thousand feet through formation 18. Use of such horizontal drilling techniques allows for an increase in the exposed wellbore length through formation 18, a reduction in the surface footprint associated with the drilling, completion and production operations as well as a reduction in costs associated with drilling, completion and production operations. Due to the length of substantially horizontal section 16, it is preferable to perform the perforating and fracturing operation in stages. For example, each stage may be several hundred feet in wellbore length. Accordingly, the perforating and fracturing operation for a wellbore such as wellbore 12 may have ten to twenty stages or more, depending upon the length of the wellbore and the length of each stage.

In general, each stage of the perforating and fracturing operation is conducted in a similar manner. After a tool string, such as tool string 24, is deployed in wellbore 12 to the desired location, isolation plug 36 is set to provide isolation from the lower stages. Once isolation plug 36 is set, tool string 24 is released therefrom and moved uphole to the desired location for the first perforation. The lowermost perforating gun 40 is then detonated. Thereafter, tool string 24 is moved uphole to the next desired location, for example fifty feet uphole, for the next perforation. The lowermost undetonated perforating gun 42 is then detonated. This process is repeated such that each remaining lowermost undetonated perforating gun 44, 46 is sequentially detonated as tool string 24 is progressively moved uphole.

It is noted that the operator is able to control the detonation of individual perforating guns 40, 42, 44, 46 while obtaining definitive feedback relating to the outcome of the activation events downhole. For example, a sequence of commands and responses is communicated between surface controller 28, downhole controller 30 and downhole remote units 60, 64, 68, 72 such that a desired one of the perforating guns may be fired. After each perforating gun has been fired and feedback has been delivered regarding the quality of the perforating event, tool string 24 may be repositioned for the next perforating event. The sequence of commands and responses is repeated such that the next desired one of the perforating guns may be fired and feedback regarding the quality of this perforating event is obtained. This process continues until all of the desired perforations have been made. As more fully described below, each of the downhole remote units, such as downhole remote units 60, 64, 68, 72, possesses a unique address such that the operator fires a particular perforating gun by selecting the downhole remote unit operably associated with the desired perforating gun using the unique address of the appropriate downhole remote unit.

Following the perforating operation, tool string 24 may be retrieved to the surface. A fracture fluid may now be pumped downhole into wellbore 12. The fracture fluid may be of any suitable type such as water, oil, oil/water emulsion, gelled water, gelled oil, carbon dioxide and nitrogen foams, water/alcohol mixtures or the like. The fracture operation preferably begins with the pumping of a pad fluid followed by a fluid carrying a propping agent, such as sand, gravel or engineered proppant. The fracture fluid is pumped downhole with sufficient flowrate and pressure to open the desired fractures in formation 18 that form high-conductivity communication paths that intersect a large area of formation 18.

As noted above, due to residual proppant in uphole sections of wellbore 12, for example, it has been found that a tool string, such as tool string 24, may become stuck in the wellbore during multistage horizontal perforating and fracturing operations such as after isolation plug 36 is set or after the firing of a perforating gun. Once tool string 24 becomes stuck in the wellbore, it may not be possible to merely pull on conveyance 26 to dislodge tool string 24 from the wellbore. In such cases, while conveyance 26 may be released at cablehead 78 and retrieved to the surface, this is not desirable as tool string 24 includes many valuable components, as detailed above, that would be left behind in the wellbore. Use of the release assemblies of the present invention in tool string 24, however, prevents this result. Each of the release assemblies can be individually interrogated and individually activated by its associated downhole remote unit to determine the location within tool string 24 to activate a desired release assembly.

For example, a sequence of commands and responses is communicated between surface controller 28, downhole controller 30 and downhole remote units 58, 62, 66, 70, 74 such that the location along tool string 24 that is stuck in wellbore 12 can be determined. Specifically, tool string 24 may be placed in tension by pulling on conveyance 26 at the surface. The tension within tool string 24 is relatively high from the top of tool string 24 to the location that tool string 24 is stuck in the wellbore. The tension within tool string 24 downhole of the location that tool string 24 is stuck in the wellbore, however, is lower. Sensors in release assemblies 48, 50, 52, 54, 56 may be used to measure this tension. The tension information is passed to downhole remote units 58, 62, 66, 70, 76 and then to downhole controller 30 for relay to surface controller 28. Thereafter, surface controller 28 can determined the location that tool string 24 is stuck in the wellbore and send an activation command to downhole controller 30 using the unique address of the appropriate downhole remote unit that is immediately uphole of the location that tool string 24 is stuck in the wellbore. That downhole remote unit can then activate the selected release assembly to separate tool string 24 such that the uphole portion of tool string 24 can be recovered to the surface or operated to continue the perforating process, while the lower portion of tool string 24 remains in the well and may be retrieved by suitable means at a later time, if desired.

Referring next to FIG. 2, therein is depicted a communication diagram of the control system for selective activation of downhole devices in a tool string that is generally designated 100. System 100 includes a surface controller 102 that is coupled to a bidirectional communication link 104 that provides for communication between surface controller 102 and a downhole controller 106. As illustrated, communication link 104 includes a communication path 108 from surface controller 102 to downhole controller 106 and a communication path 110 from downhole controller 106 to surface controller 102. In certain embodiments, bidirectional communication may be achieved via a half duplex channel which allows only one of communication paths 108, 110 to be open in any time period. Preferably, bidirectional communication is achieved via a full duplex channel which allows simultaneous communication over communication paths 108, 110. This can be achieved, for example, by providing independent hardwire connections or over a shared physical media through frequency division duplexing, time division duplexing, echo cancellation or similar technique. In either case, communication link 104 may include one or more electrical conductors, optical conductors or other physical conductors. As described above, the downhole controller is supported within the wellbore on a conveyance such as an electric line that may be used to couple surface controller 102 to downhole controller 106. In this configuration, the conveyance preferably includes the physical media that provides communication link 104 including communication paths 108, 110. Together, surface controller 102, downhole controller 106 and communication link 104 form a first communication network of system 100.

Downhole controller 106 is also coupled to a bidirectional communication link 112 that provides communication between downhole controller 106 and each of a plurality of downhole remote units 114, 116, 118, 120. As illustrated, communication link 112 includes a communication path 122 from downhole controller 106 to downhole remote units 114, 116, 118, 120 and a communication path 124 from downhole remote units 114, 116, 118, 120 to downhole controller 106. As described above, bidirectional communication may be achieved via a half duplex channel or preferably via a full duplex channel. The communication media of communication link 112 may be one or more electrical conductors, optical conductors or other physical conductors. Together, downhole controller 106, downhole remote units 114, 116, 118, 120 and communication link 112 form a second communication network of system 100.

As downhole controller 106 is a component in both the first and the second communication networks of system 100, downhole controller 106 is operable to serve as a relay between surface controller 102 and downhole remote units 114, 116, 118, 120. This feature of the present invention enables each of the downhole remote units 114, 116, 118, 120 to operate at a lower power level as communications between downhole remote units 114, 116, 118, 120 and downhole controller 106 take place over a short distance whereas, communications between downhole controller 106 and surface controller 102 take place over a long distance requiring higher power. As such, the second communication network may operate at a lower power level then the first communication network.

In the illustrated embodiment, each of the downhole remote units 114, 116, 118, 120 is in communication with a downhole device. Specifically, downhole remote unit 114 is in communication with downhole device 126, downhole remote unit 116 is in communication with downhole device 128, downhole remote unit 118 is in communication with downhole device 130, and downhole remote unit 120 is in communication with downhole device 132. The communication path between respective downhole remote units and downhole devices may be bidirectional or unidirectional. These communication paths provide at least the ability to send a voltage, current or other signal from a downhole remote unit to a downhole device to activate the downhole device and preferably providing the ability to receive a reply signal from a downhole device to a downhole remote unit responsive to an interrogation thereof. In the example illustrated above wherein the downhole devices are perforating guns and release assemblies, a downhole remote unit may send a voltage signal such as 40 volts, 200 volts or other voltage to active a desired perforating gun or release assembly. In addition, data communication between the downhole remote units, the perforating guns and release assemblies may be exchanged to determine a state or property associated a perforating gun or a release assembly, such as the level of tension in a release assembly. Those skilled in the art will recognize, however, that the signal sent from a downhole remote unit to a downhole device to activate or interrogate that downhole device will depend on the type of downhole device and the desired type of response or outcome associated with the communication. In addition, even though a particular number of downhole remote units and downhole devices has been depicted and described, those skilled in the art will recognize that any number of downhole remote units and downhole devices could be operated according to the present invention.

Referring next to FIG. 3A, therein is depicted a functional block diagram of surface controller 102 that is operable in the control system for selective activation of downhole devices in a tool string of the present invention. Surface controller 102 includes a user interface 152 including, for example, input and output devices such as one or more video screens or monitors, including touch screens, one or more keyboards or keypads, one or more pointing or navigation devices, as well as any other user interface devices that are currently known to those skilled in the art or are developed. The user interface 152 may take the form of a computer including a notebook computer.

Surface controller 102 also includes a logic module 154 that may include various controllers, processors, memory components, operating systems, instructions, communication protocols and the like for implementing the systems and methods for selective activation of downhole devices in a tool string of the present invention. In one embodiment, logic module 154 is operable to communicate via communication link 104 (FIG. 2) with downhole controller 106. Logic module 154 is operable to issue commands to the downhole controller 106 and receive information from the downhole controller 106. As an example, logic module 154 may issue an enable command which initiates a status check of downhole controller 106 as well as a status check of the downhole remote units 114, 116, 118, 120. The status information returned to logic module 154 may include the operational or short/fault/non operational status of each of the downhole remote units. As another example, logic module 154 may issue a command to interrogate or activate one of the downhole devices associated with a downhole remote unit.

For example, in an implementation wherein downhole remote units are operably associated with release assemblies, logic module 154 may send a unique command to the deepest downhole remote unit, for example, the downhole remote unit operably associated with the release assembly of the isolation plug (FIG. 1). The initial command may be a request for information regarding the tension level in that release assembly. Additional commands may also be sent by logic module 154 to less deep downhole remote units using each of their unique addresses also requesting information regarding the tension level in the associated release assemblies. As logic module 154 receives feedback from the downhole remote units regarding the various tension levels, the location at which the tool string is stuck may be determined by comparing the level of tension in the various release assemblies. Thereafter, logic module 154 may send a command to the deepest downhole remote unit uphole of the location at which the tool string is stuck to actuate that release assembly, thereby disengaging an upper portion of the tool string from a lower portion of the tool string enabling retrieval or further operation of the upper portion of the tool string.

As should be understood by those skilled in the art, any of the functions described with reference to a logic module herein can be implemented using software, hardware including fixed logic circuitry, manual processing or a combination of these implementations. As such, the term "logic module" as used herein generally represents software, hardware or a combination of software and hardware. For example, in the case of a software implementation, the term "logic module" represents program code and/or declarative content, e.g., markup language content, which performs specified tasks when executed on a processing device or devices such as one or more processors or CPUs. The program code can be stored in one or more computer readable memory devices. More generally, the functionality of the illustrated logic modules may be implemented as distinct units in separate physical grouping or can correspond to a conceptual allocation of different tasks performed by a single software program and/or hardware unit. The illustrated logic modules can be located at a single site such as implemented by a single processing device, or can be distributed over plural locations such as a notebook computer or personal digital in combination with other physical devices that communication with one another via wired or wireless connections.

Referring next to FIG. 3B, therein is depicted a functional block diagram of a downhole controller 106 that is operable in the control system for selective activation of downhole devices in a tool string of the present invention. Downhole controller 106 may include a plurality of sensors 162 including, for example, one or more accelerometers, pressure sensors including high speed pressure sensors, temperature sensors, voltage and current sensors, a casing collar locator, a gamma detector as well as other sensors known to those skilled in the art. Using these sensors, downhole controller 106 is operable to provide certain feedback to surface controller 102 regarding a variety of downhole conditions and events. For example, correlation information may be obtained using the casing collar locator as well as the gamma detector. Also, the voltage and current sensors may be used to determine the occurrence or non occurrence of an actuation event such as firing a perforating gun or operating a release assembly. As another example, in a perforating gun system implementation, the accelerometers, pressure sensors, high speed pressure sensors and temperature sensors allow substantially real time analysis of the near perforation events.

Downhole controller 106 also includes a logic module 164 that includes various controllers, processors, memory components, operating systems, instructions, communication protocols and the like for implementing the systems and methods for selective activation of downhole devices in a tool string of the present invention. As explained above, logic module 164 is an active part of the first and the second communication networks of the system of the present invention. Logic module 164 acts as a relay for bridging the communications between surface controller 102 and downhole remote units 114, 116, 118, 120. Logic module 164 is operable to received commands from surface controller 102 and relay such commands to one or more of the downhole remote units. In addition, logic module 164 is operable to received feedback corresponding to the commands from the downhole remote units which is relayed to surface controller 102. For example, logic module 164 may receive a tension level request command from surface controller 102. In this case, logic module 164 relays this command to each of the relevant downhole remote units, which interrogate respective release assemblies. After each of the relevant downhole remote units responds to logic module 164, logic module 164 returns the information to surface controller 102 for processing and analysis.

Referring next to FIG. 3C, therein is depicted a functional block diagram of a downhole remote unit 120 that is operable in a control system for selective activation of downhole devices in a tool string of the present invention. Downhole remote unit 120 includes a device controller 172 that is operable to send a signal to a downhole device to interrogate or activate that downhole device. Device controller 172 may include one or more leads that provide or prevent a current from passing to the downhole device. In this configuration, the circuitry of the downhole device may be held at ground or shunted until such time as device controller 172 is instructed to allow a current to pass thereto. This feature allows all downhole remote units to be fully tested without inadvertently initializing one of the downhole devices.

Downhole remote unit 120, which is representative of each of the downhole remote units but has been described as being the lowermost downhole remote unit, includes a logic module 174 that includes, for example, various fixed logic circuits, controllers, processors, memory components, operating systems, instructions, communication protocols and the like for implementing the systems and methods for selective activation of downhole devices in a tool string of the present invention. Each of the downhole remote units is substantially similar, however, each includes its own unique address, such as an eight, sixteen, thirty-two or other bit unique digital address. Logic module 174 is operable to receive an enable command sent from downhole controller 106, which may simply be a power on signal. Once the enable command is received, each of the downhole remote units may sequentially goes through an automated initialization process. This process results in the operational downhole remote units returning a positive status signal to downhole controller 106, which is passed to surface controller 102. Thereafter, the logic module 174 of any one of the operational downhole remote units may be addressed by surface controller 102 via downhole controller 106 to interrogate or activate an associated downhole device.

Referring next to FIG. 3D, therein is depicted a functional block diagram of a downhole device 132 that is in communication with the control system for selective activation of downhole devices in a tool string of the present invention. Downhole device 132 may include one or more sensors 176 that are operable to be interrogated by the associated downhole remote unit. For example, in a perforating gun implementation, the sensors may include moisture sensors, pressure sensors, temperature sensors or the like. As another example, in a release assembly implementation, the sensor may include strain gauges or other sensors operable to determine the level of tension within a release assembly.

Downhole device 132, which is representative of any of the downhole devices discussed herein but has been described as being the lowermost downhole device 132, includes an actuator 178 that is operable to cause downhole device 132 to change operational states. For example, in a perforating gun implementation, upon receiving an activation signal from the associated downhole remote unit, actuator 178 initiates the firing sequence. As another example, in a release assembly implementation, upon receiving an activation signal from the associated downhole remote unit, actuator 178 initiates the mechanical operation of the release assembly.

Referring next to FIGS. 4A-4D, therein is depicted a release assembly of the present invention in various views that is generally designated 200. In the illustrated embodiment, release assembly 200 has an outer housing 202 that includes an upper pin end 204 operable for enabling threadable coupling of release assembly 200 to other tools in a tool string, such as tool string 24. Disposed within outer housing 202 is a fishing receptacle 206 having a fishing neck 208 for enabling a fishing tool to connect thereto. Fishing receptacle 206 also has a lower box end 210 operable for enabling threadable coupling of release assembly 200 to other tools in a tool string, such as tool string 24. As illustrated, fishing receptacle 206 is securably coupled to outer housing 202 by a plurality of shear screws 212.

Figure 4B:
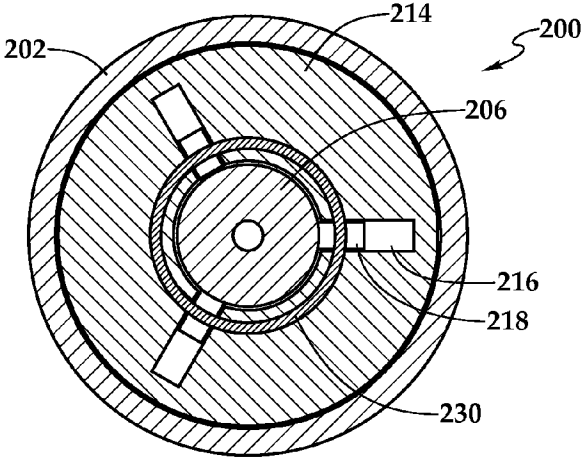
FIG. 4B is a cross sectional view of the release assembly of FIG. 4A taken along line 4B-4B.
Figure 4A:
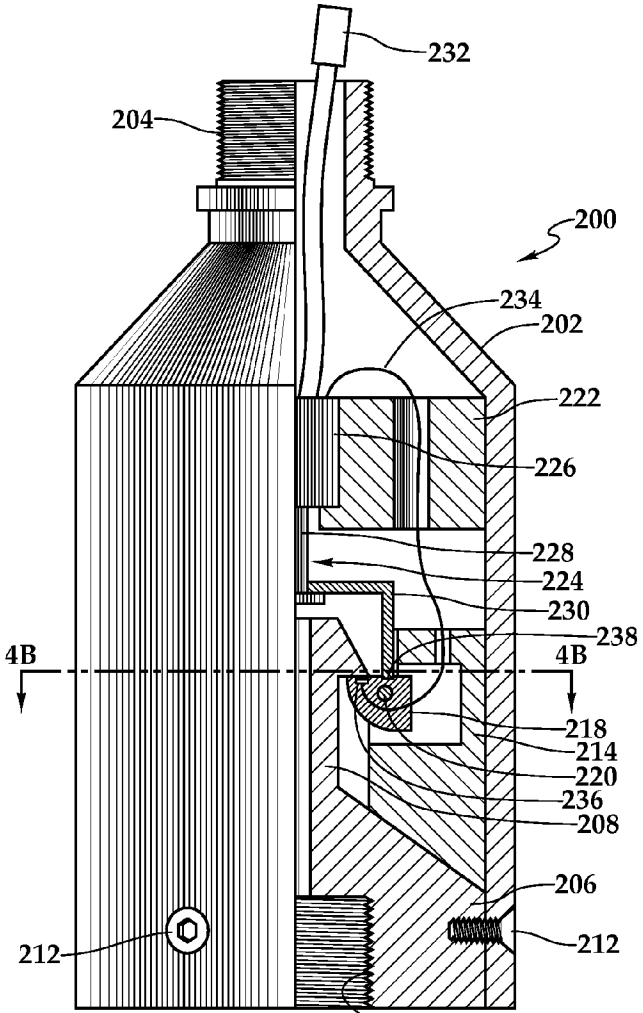
FIG. 4A is a quarter sectional view of a release assembly for use in a tool string according to an embodiment of the present invention in its unactuated position.

Securably disposed within housing 202 is a support assembly 214 having a plurality of slots 216 formed therein and including a plurality of jaws 218 that are hingably coupled via pins 220 within slots 216. Also securably disposed within housing 202 is an actuator receiver 222 that is operably to receive an actuator assembly 224 therein. In the illustrated embodiment, actuator assembly 224 includes an electromechanical solenoid 226, a piston 228 and an actuator sleeve 230 that is securably coupled to piston 228 by threading or other suitable means. Solenoid 226 may be coupled to the communication link of a downhole remote unit via cable connection 232. In addition, electronics housed within solenoid 226 may be electrically coupled via communication link 234 to one or more sensors 236, such as strain gauges or other tension sensors that may be associated with jaws 218, as illustrated, fishing receptacle 206, outer housing 202 or other component within release assembly 200. Preferably, the lower end of actuator sleeve 230 is received within notches 238 in the upper surfaces of jaws 218 which secure release assembly 200 in its unactuated configuration, as depicted in FIGS. 4A-4B. Specifically, in the unactuated configuration, downward force is placed on jaws 218 by actuator sleeve 230 which prevents rotation of jaws 218 and forces jaws 218 to support fishing receptacle 206 which prevents downward movement of fishing receptacle 206.

An operation of the present invention will now be described. Prior to communication with a downhole tool, the control system of the present invention is preferably initialized to determine whether all downhole remotes are operational. In this process, an enable command is sent from the surface controller to the downhole controller over a first bidirectional communication link that may be operably associated with the conveyance. In turn, the downhole controller sends the enable command to the first downhole remote unit of the tool string over a second bidirectional communication link. In certain embodiments, the enable command sent from the downhole controller may include the address of the downhole remote unit, such as a sixteen bit address, an argument containing an instruction for the downhole remote unit, such as a sixteen bit argument, and a redundancy check, such as a checksum or other error checking functionality to assure there is no corruption in the enable command.

If the first downhole remote unit of the tool string does not respond, then the downhole controller reports back to the surface controller that the system failed to initialize. If the first downhole remote unit of the tool string is operational, it sends a response back to the downhole controller. The response may be, for example, an echo of the downhole remote unit's address or other data string. Once the first downhole remote unit responds, an enable command is sent to the next downhole remote unit down the tool string by either the downhole controller sending an enable command directly to the next downhole remote unit after receiving confirmation from the prior downhole remote unit or by the prior downhole remote unit passing on the previously received enable command. After each subsequent downhole remote unit responds to the enable command, the next lower downhole remote unit receives an enable command. Once the enable process has progressed to the last downhole remote unit, the downhole controller may send the operational status of each of the downhole remote units to the surface controller over the first communication link.

Once the initialization process is complete, in the case of a stuck tool string, the following operation may proceed. The tool string is placed in tension by pulling on the conveyance. The surface controller sends a tension level request message to the downhole controller over the first bidirectional communication link. The request includes the unique address of each of the downhole remote units that the message is intended for, in this case, downhole remote units 58, 62, 66, 70, 74 (see FIG. 1). The downhole controller then sends each of the downhole remote units the tension level request message over the second bidirectional communication link. The downhole remote units 58, 62, 66, 70, 74 then send respective interrogations to the sensors in release assemblies 48, 50, 52, 54, 56. Information regarding tension levels in each of the release assemblies 48, 50, 52, 54, 56 is returned to the downhole remote units 58, 62, 66, 70, 74, which in turn pass the information to the downhole controller over the second bidirectional communication link. The downhole controller relays the information to the surface controller over the first bidirectional communication link.

Based upon the tension level information, the surface controller or operator may now determine the location of the tool string at which it is stuck in the wellbore. For example, by comparing the level of tension in the various release assemblies, it may be determined that only isolation plug 36 and a setting tool 38 are stuck, if all the release assemblies read approximately the same tension level. As another example, if release assemblies 48, 50 read a high level of tension while release assemblies 52, 54, 56 read a low level or no tension, it can be determined that the tool string is stuck at or near perforating gun 44. In either case, once the location of the tool string at which it is stuck in the wellbore is determined, the surface controller identifies the nearest downhole control unit that is uphole thereof.

Following this location determination process or if the desired release assembly is known through other analysis, the surface controller sends an actuate command to the downhole controller over the first bidirectional communication link that is intended for the desired downhole control unit which may be specified using the address of the desired downhole control unit. The downhole controller receives the actuate command from the surface controller and relays the command down the second bidirectional communication link to the desired downhole control unit. The actuate command may be formatted as a three word series containing the desired downhole control unit's address, the command argument and a redundancy check to validate the command sequence. This actuate command may be used by the downhole remote unit to establish an initiation voltage or other signal which is applied to the desired release assembly to initiate actuation thereof.

Figure 4D:
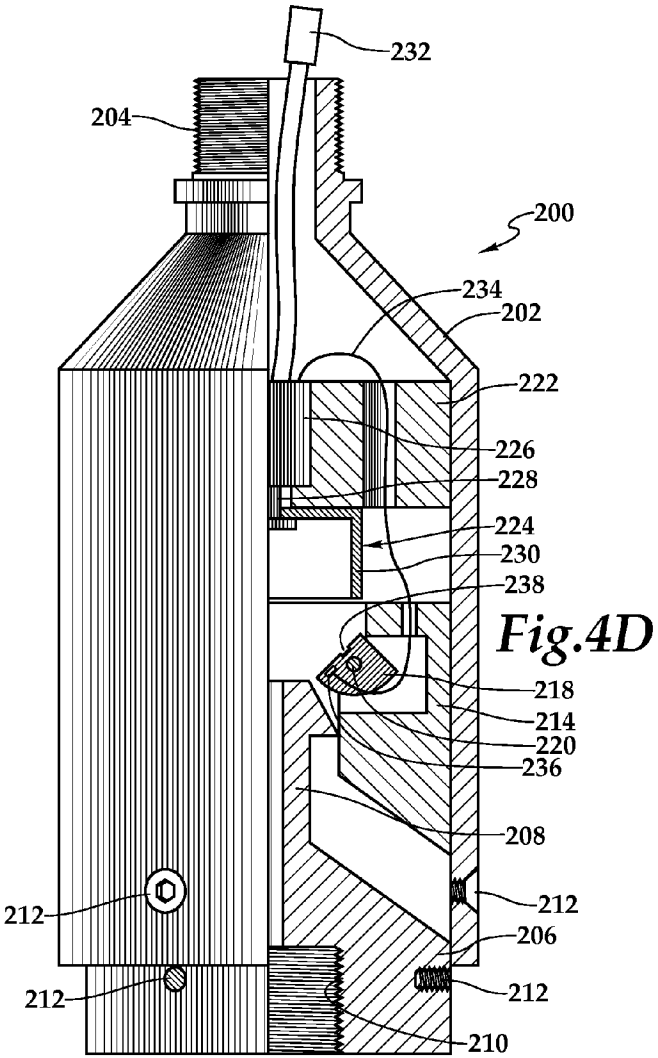
FIG. 4D is a quarter sectional view of a release assembly for use in a tool string according to an embodiment of the present invention in its sheared position.
Figure 4C:
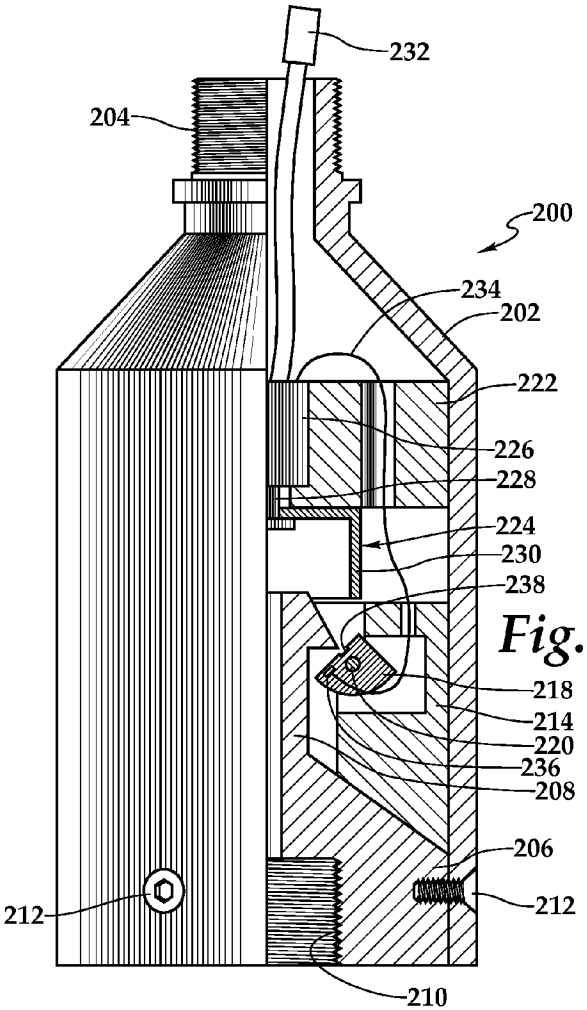
FIG. 4C is a quarter sectional view of a release assembly for use in a tool string according to an embodiment of the present invention in its actuated position.

For example, if it is determined that only isolation plug 36 and a setting tool 38 are stuck, the actuate command is sent to downhole remote unit 58 and the voltage is sent to actuator 224 (see FIG. 4A) of release assembly 48. The voltage acts within electromechanical solenoid 226 which causes piston 228 and actuator sleeve 230 to shift in the uphole direction releasing jaws 218 from fishing neck 208, as best seen in FIG. 4C. Thereafter, application of sufficient tension on release assembly 48 will cause screws 212 to shear which separates the upper portion of tool string 24 including the entire downhole control system and the perforating guns from the lower portion of tool string 24 including only the isolation plug and setting tool, as best seen in FIG. 4D.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method for releasing a portion of a tool string downhole of a release assembly positioned in a wellbore, the method comprising:
- providing a surface controller;
- running the tool string into the wellbore, the tool string including a downhole controller, a plurality of downhole remote units, a release assembly operably associated with a first one of the downhole remote units and a downhole tool positioned downhole of the release assembly;
- sticking the tool string in the wellbore;
- sending an actuation command including an address of the first downhole remote unit from the surface controller to the downhole controller;
- relaying the actuation command from the downhole controller to the first downhole remote unit;
- sending an actuation signal from the first downhole remote unit to the release assembly; and
- actuating the release assembly to release the portion of the tool string downhole thereof including the downhole tool by electrically actuating a first release member to enable relative axial movement between a fishing receptacle and an outer housing of the release assembly then mechanically actuating a second release member to decouple the fishing receptacle from the outer housing.

2. The method as recited in claim 1 wherein sticking the tool string in the wellbore further comprises operating the downhole tool.

3. The method as recited in claim 2 wherein operating the downhole tool further comprising detonating a perforating gun.

4. The method as recited in claim 2 wherein operating the downhole tool further comprising setting an isolation plug.

5. The method as recited in claim 1 wherein sending the actuation command including the address of the first downhole remote unit further comprising sending an actuation command including a unique digital address of the first downhole remote unit.

6. The method as recited in claim 1 wherein sending the actuation signal from the first downhole remote unit to the release assembly further comprising sending a voltage signal.

7. The method as recited in claim 1 wherein electrically actuating the first release member further comprises operating a solenoid to shift a sleeve out of engagement with jaws of a support assembly to release a fishing neck of the fishing receptacle and wherein mechanically actuating the second release member further comprises shearing at least one shearable member initially coupling the fishing receptacle to the outer housing.

8. A method for releasing a portion of a tool string downhole of a release assembly positioned in a wellbore, the method comprising:
- providing a surface controller;
- running the tool string including a downhole controller, a plurality of downhole remote units and a plurality of release assemblies each operably associated with one of the downhole remote unit into the wellbore;
- sticking the tool string in the wellbore;
- placing the tool string in tension;
- obtaining tension information at the surface controller from the release assemblies;
- identifying the first release assembly uphole of a location wherein the tool string is stuck based upon the tension information;
- sending an actuation command to the downhole remote unit operably associated with the first release assembly via the downhole controller;
- sending an actuation signal to the first release assembly from the downhole remote unit operably associated therewith; and
- actuating the first release assembly to release the portion of the tool string downhole thereof by electrically actuating a first release member to enable relative axial movement between a fishing receptacle and an outer housing of the release assembly then mechanically actuating a second release member to decouple the fishing receptacle from the outer housing.

9. The method as recited in claim 8 wherein sticking the tool string in the wellbore further comprises operating a downhole tool disposed within the tool string.

10. The method as recited in claim 8 wherein identifying the first release assembly uphole of the location wherein the tool string is stuck further comprises comparing tension information from each of the release assemblies to determine the location wherein the tool string is stuck.

11. The method as recited in claim 8 wherein sending the actuation signal to the first release assembly from the downhole remote unit operably associated therewith further comprising sending a voltage signal.

12. The method as recited in claim 8 electrically actuating the first release member further comprises operating a solenoid to shift a sleeve out of engagement with jaws of a support assembly to release a fishing neck of the fishing receptacle and wherein mechanically actuating the second release member further comprises shearing at least one shearable member initially coupling the fishing receptacle to the outer housing.

13. A system for releasing a portion of a tool string positioned in a wellbore, the system comprising:
- a surface controller;
- a downhole controller positioned within the tool string and operable to communicate with the surface controller;
- a plurality of downhole remote units positioned within the tool string and operable to communicate with the downhole controller;
- a release assembly positioned within the tool string and operably associated with a first one of the downhole remote units, the release assembly including an outer housing, a fishing receptacle disposed within the housing, the fishing receptacle having a fishing neck, a first release member initially coupling the fishing receptacle to the outer housing, a support assembly disposed within the housing, the support assembly having a first position wherein the support assembly engages the fishing neck to prevent relative axial movement between the fishing receptacle and the housing and a second position wherein the support assembly is disengaged from the fishing neck no longer preventing relative axial movement between the fishing receptacle and the housing and a second release member disposed within the housing, the second release member initially maintaining the support assembly in the first position; and a downhole tool positioned within the tool string downhole of the release assembly, wherein, an actuation command including an address of the first downhole remote unit is sent from the surface controller to the downhole controller, the actuation command is relayed from the downhole controller to the first downhole remote unit, and an actuation signal is sent from the first downhole remote unit to the release assembly to electrically actuate the second release member shifting the support assembly from the first position to the second position, and wherein, after shifting the support assembly to the second position, mechanical actuation of the first release member decouples the fishing receptacle and the outer housing.

14. The system as recited in claim 13 wherein the downhole tool is selected from the group consisting of a perforating gun and an isolation plug.

15. The system as recited in claim 13 wherein the address of the first downhole remote unit further comprising a unique digital address.

16. The system as recited in claim 13 wherein the actuation signal further comprises a voltage signal.

17. The system as recited in claim 13 wherein the second release member further comprises a solenoid and an actuator sleeve operably associated with the solenoid, the actuator sleeve engaging rotatable jaws to maintain engagement of the rotatable jaws with the fishing neck until electrical actuation of the solenoid shifts the actuator sleeve enabling rotation of the rotatable jaws out of engagement with the fishing neck.

18. The system as recited in claim 13 wherein the first release member further comprises at least one shearable member.

19. The system as recited in claim 13 wherein the first release member further comprises a plurality of shearable members.

20. The system as recited in claim 19 wherein the plurality of shearable members are circumferentially distributed about the outer housing.

* * * * *